US006155881A

United States Patent [19]

Arnett et al.

[11] Patent Number: 6,155,881

[45] Date of Patent: Dec. 5, 2000

[54] ELECTRICAL CONNECTOR WITH SIGNAL COMPENSATION

[75] Inventors: Jaime Ray Arnett, Fishers; Richard Wynn Curry, Fountaintown; Julian Robert Pharney, Indianapolis, all of Ind.

[73] Assignee: Lucent Technologies Inc., Murray Hill, N.J.

[21] Appl. No.: 09/241,987

[22] Filed: Feb. 2, 1999

[51] Int. Cl.[7] ..... H01R 21/22

[52] U.S. Cl. ..... 439/676; 439/941

[58] Field of Search ..... 439/676, 620, 439/941, 79–83

[56] References Cited

U.S. PATENT DOCUMENTS

| | | | |
|---|---|---|---|
| 4,566,749 | 1/1986 | Johnston | 439/441 |
| 5,096,442 | 3/1992 | Arnett et al. . | |
| 5,478,261 | 12/1995 | Bogese, II | 439/676 |
| 5,647,767 | 7/1997 | Scheer et al. . | |
| 5,674,093 | 10/1997 | Vaden . | |

*Primary Examiner*—Khiem Nguyen
*Assistant Examiner*—Son V. Nguyen
*Attorney, Agent, or Firm*—Law Office of Leo Zucker

[57] ABSTRACT

An electrical connector assembly has a terminal housing, and a number of electrically conductive connector assembly terminals supported by the housing. The connector assembly terminals have mid-sections that protrude from the housing for contacting terminals of a mating connector, and outside connection ends for making electrical connections with outside circuits. Free ends of the connector assembly terminals next to the terminal mid-sections and opposite the outside connection ends, are positioned inside the terminal housing. An electrical circuit component is mounted inside the terminal housing. The circuit component is connected to the free ends of the assembly terminals, so that the mating connector becomes electrically connected to the circuit component through paths between the mid-sections and the free ends of the assembly terminals, in proximity to the circuit component. The electrical circuit component may be constructed and arranged to compensate for cross talk induced when the mating connector contacts the mid-sections of the assembly terminals.

22 Claims, 9 Drawing Sheets

ELECTRICAL CONNECTOR WITH SIGNAL COMPENSATION

REFERENCE TO RELATED APPLICATION

Co-pending U.S. patent application Ser. No. 09/241,934 filed Feb. 2, 1999, entitled "Communication Connector With Signal Compensation", which application is assigned to the assignee of the present application.

BACKGROUND OF THE INVENTION

1. Field of the Invention

This invention relates generally to electrical connectors, and particularly to an electrical communication connector constructed and arranged to compensate for cross talk among signal paths carried by the connector.

2. Discussion of the Known Art

There is a need for a durable, high frequency electrical communication connector that compensates for or reduces cross talk among signal paths carried by the connector. As broadly defined herein, cross talk occurs when signals conducted over a first signal path through a pair of mated connectors are partly transferred by electromagnetic coupling into a second, adjacent signal path through the mated connectors. The transferred signals become "cross talk" in the second signal path, and they act to degrade any signals that are being routed over the second signal path.

For example, an industry type RJ-45 electrical communication connector has four pairs of terminals for carrying four different signal paths. In typical RJ-45 plug and jack connectors, all four pairs of conducting terminals extend closely parallel to one another over the lengths of the connectors. Thus, cross talk may be induced between and among different signal paths through the typical mated RJ-45 connectors. The induced cross-talk also becomes stronger as signal frequencies or data rates increase.

One known arrangement for compensating a connector for cross talk induced among terminals of the connector, uses a multi-layer board having printed wire traces that are aligned vertically with one another on different layers of the board. The traces are selectively connected to the terminals of the connector, and operate to compensate for (i.e., to cancel or reduce) cross talk that would otherwise develop at the connector terminals. See U.S. patent application Ser. No. 08/668,553 filed Jun. 21, 1996, and assigned to the assignee of the present invention and application. All relevant portions of the '553 application are incorporated by reference herein.

The above described multi-layer board arrangement may be applied to a communication jack connector, to compensate for cross talk originating from an offending, uncompensated mating plug connector. In one arrangement, the board traces are electrically connected to certain jack terminals at locations where the terminals connect with outside circuits or cable wire leads. See U.S. patent application Ser. No. 08/904,391 filed Aug. 1, 1997. See also application Ser. No. 08/923,741 filed Sep. 29, 1997. Both of the '391 and the '741 applications are assigned to the assignee of the present invention and application. All relevant portions of the mentioned applications are incorporated by reference herein.

U.S. Pat. No. 5,647,767 (Jul. 15, 1997) shows a connector jack assembly having network signal conditioning components such as choke coils, filter circuits and transformers, connected in series with contact terminals which engage a mating connecting plug. The components are arranged on a printed circuit board with contact pads on both sides of the board.

Wired communication links and networks are now being called upon to support data rates not just up to 100 MHz or industry standard "Category 5" performance, but up to as much as 250 MHz or "Category 6" performance levels. For the latter, the above described arrangements for reducing connector-induced cross talk have not proven adequate, however.

SUMMARY OF THE INVENTION

According to the invention, an electrical connector assembly includes a terminal housing, and a number of electrically conductive connector assembly terminals supported by the housing. The connector assembly terminals have mid-sections that protrude a certain distance from the housing for contacting corresponding terminals of a mating connector, and outside connection ends for electrically connecting the connector assembly terminals with outside circuits. Free ends of the connector assembly terminals adjacent the mid-sections of the terminals and opposite the outside connection ends, are positioned inside the terminal housing. An electrical circuit component is mounted inside the terminal housing. The circuit component is connected electrically to the free ends of the connector assembly terminals. The mating connector will thus be electrically connected to the circuit component through paths between the mid-sections and the free ends of the assembly terminals, in proximity to the circuit component.

In a particular embodiment, the electrical circuit component is constructed and arranged to compensate for cross talk induced when the mating connector contacts the mid-sections of the connector assembly terminals.

For a better understanding of the invention, reference is made to the following description taken in conjunction with the accompanying drawing and the appended claims.

DETAILED DESCRIPTION OF THE INVENTION

Figure 1:
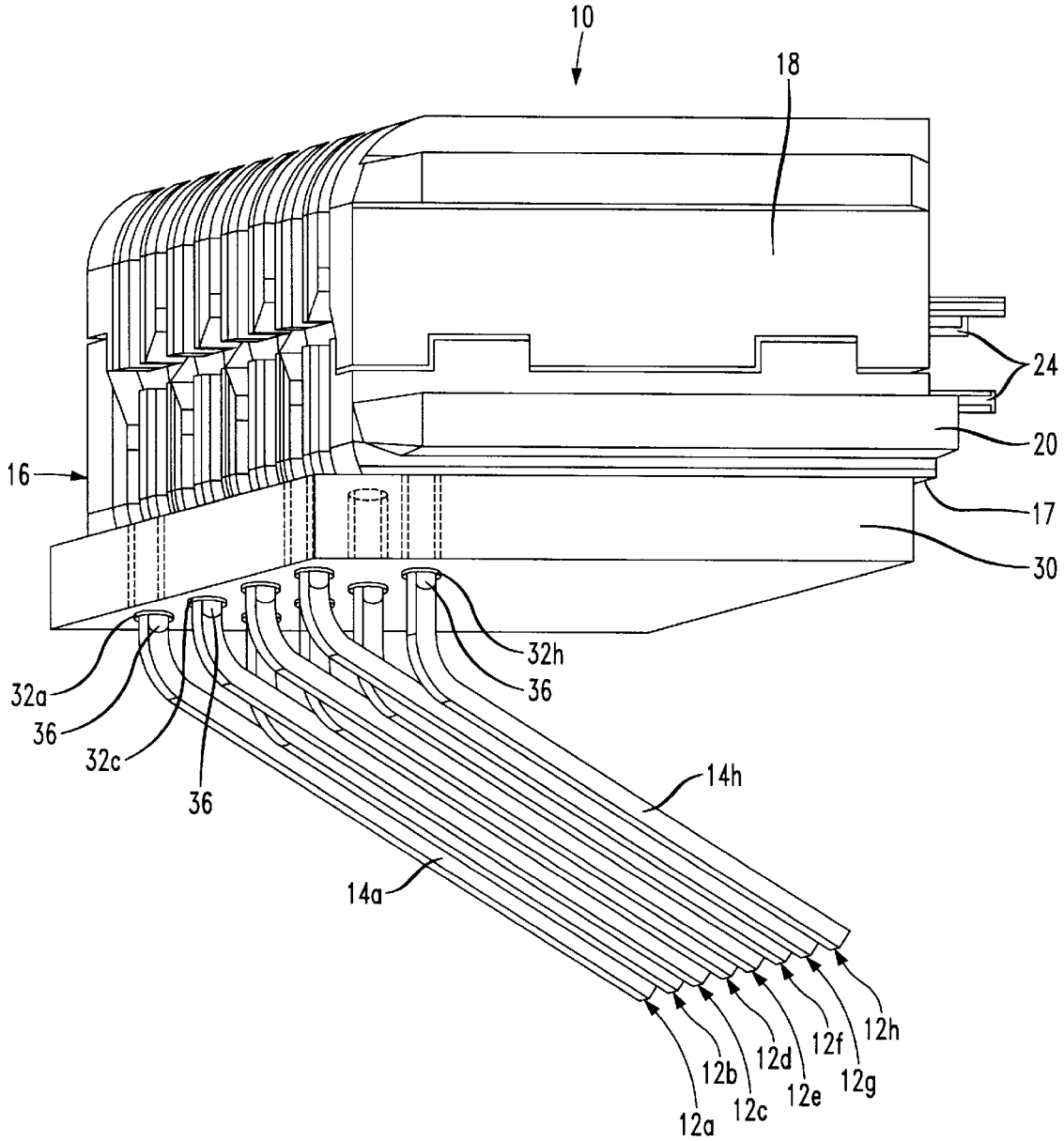
FIG. 1 is a perspective view of a first embodiment of a communication connector assembly.

FIG. 1 is a perspective view of a first embodiment of a communication connector assembly 10. The assembly 10 includes a number, for example, eight electrically conductive connector assembly terminals 12*a* thru 12*h*. In the illustrated embodiment, the terminals 12*a*–12*h* are in the form of continuous, elongated spring jack wires having first, parallel terminal portions 14*a*–14*h* that project from a front portion of an insulative dielectric terminal housing 16. The first terminal portions 14*a*–14*h* lie in a plane that forms an acute angle with a bottom surface 17 of the housing 16. Free ends of the first terminal portions are positioned beneath a rear portion of terminal housing 16, toward the right side of FIG. 1. The first terminal portions 14*a*–14*h* are thus arranged to contact corresponding exposed terminals of a mating plug connector. See FIG. 4. The connector assembly terminals 12*a*–12*h* also have second terminal portions 22*a*–22*h*, shown in FIG. 2, for making electrical connections between the connector assembly 10 and outside circuits.

The terminal housing 16 is a two-part housing comprising a housing top part 18 and a housing bottom part 20. The terminal housing 16 supports the second terminal portions 22*a*–22*h* of the assembly terminals within corresponding parallel guideways 23 which are formed when the top part 18 and the bottom part 20 of the housing are snapped or otherwise joined together from the position in FIG. 2 to that in FIG. 1. The second terminal portions 22*a*–22*h* have corresponding terminal posts 24 at the rear of the terminal housing 16. For example, the terminal posts may be formed with a known "needle eye" configuration that allows them to be press-fitted in corresponding terminal openings in an outside printed wire board, as in FIG. 4. Alternatively, the second terminal portions 22*a*–22*h* may terminate with insulation displacement connector (IDC) terminals supported in an adjacent terminal housing (not shown). Outside wire leads may then be electrically connected to such IDC terminals in a known manner.

Figure 2:
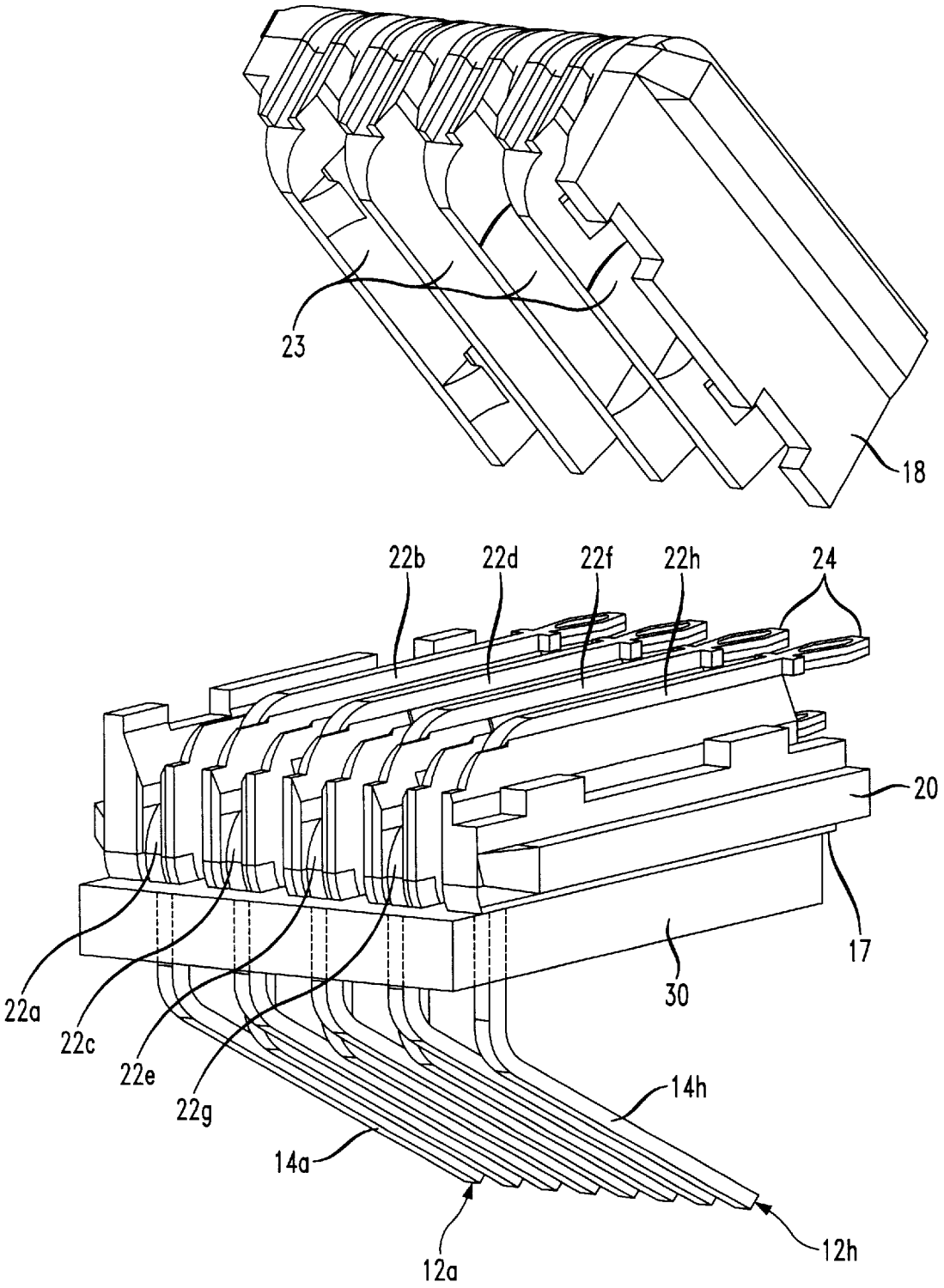
FIG. 2 is an exploded view of the communication connector assembly in FIG. 1.

As shown in FIG. 2, the second terminal portions 22*a*–22*h* of the connector assembly terminals extend between the front and the back of the terminal housing 16, within the mentioned parallel guideways 23. After terminals 12*a*, 12*c*, 12*e* and 12*g* enter the housing 16 from below, the second terminal portions 22*a*, 22*c*, 22*e* and 22*g* are seated in associated guideways and lie in a common horizontal plane. After the terminals 12*b*, 12*d*, 12*f* and 12*h* enter the housing 16 from below, their second terminal portions 22*b*, 22*d*, 22*f* and 22*h* are likewise seated in associated guideways and lie in a plane that is offset vertically above the plane containing the second terminal portions 22*a*, 22*c*, 22*e* and 22*g*.

An electrical circuit component 30 is disposed adjacent the terminal housing 16, beneath the housing bottom part 20 as seen in FIG. 1. The component 30 may comprise, for example, a multi-layer printed wire board that is constructed and arranged to compensate for cross talk produced when the mating connector contacts the first terminal portions 14*a*–14*h*. For example, the board may have wire traces printed on two or more layers, such that vertically aligned traces on the layers produce capacitive cross-talk compensation as disclosed in the earlier mentioned '553 Application.

The electrical circuit component 30 has a number of component terminals 32*a*–32*h* which connect to compensating elements (not shown) such as, e.g., internal printed wire traces, and any discrete elements of the component such as resistors, inductors, capacitors or active devices. Corresponding ones of the connector assembly terminals 12*a*–12*h* connect to the component terminals just prior to entering the bottom part 20 of the terminal housing 16. In the illustrated embodiment, the connector assembly terminals have associated contact portions 36 intermediate the free ends of their first terminal portions, and the second terminal portions of the assembly terminals. The contact portions 36 are fitted within openings in the component terminals. The contact portions may comprise, for example, enlarged cross-section "needle-eye" formations along the lengths of the connector terminals, so that reliable electrical connections are established when the contact portions 36 are pressed through the component terminals. The mating connector thus becomes electrically connected to the circuit component through the first terminal portions of the assembly terminals, in proximity to the circuit component.

Figure 3:
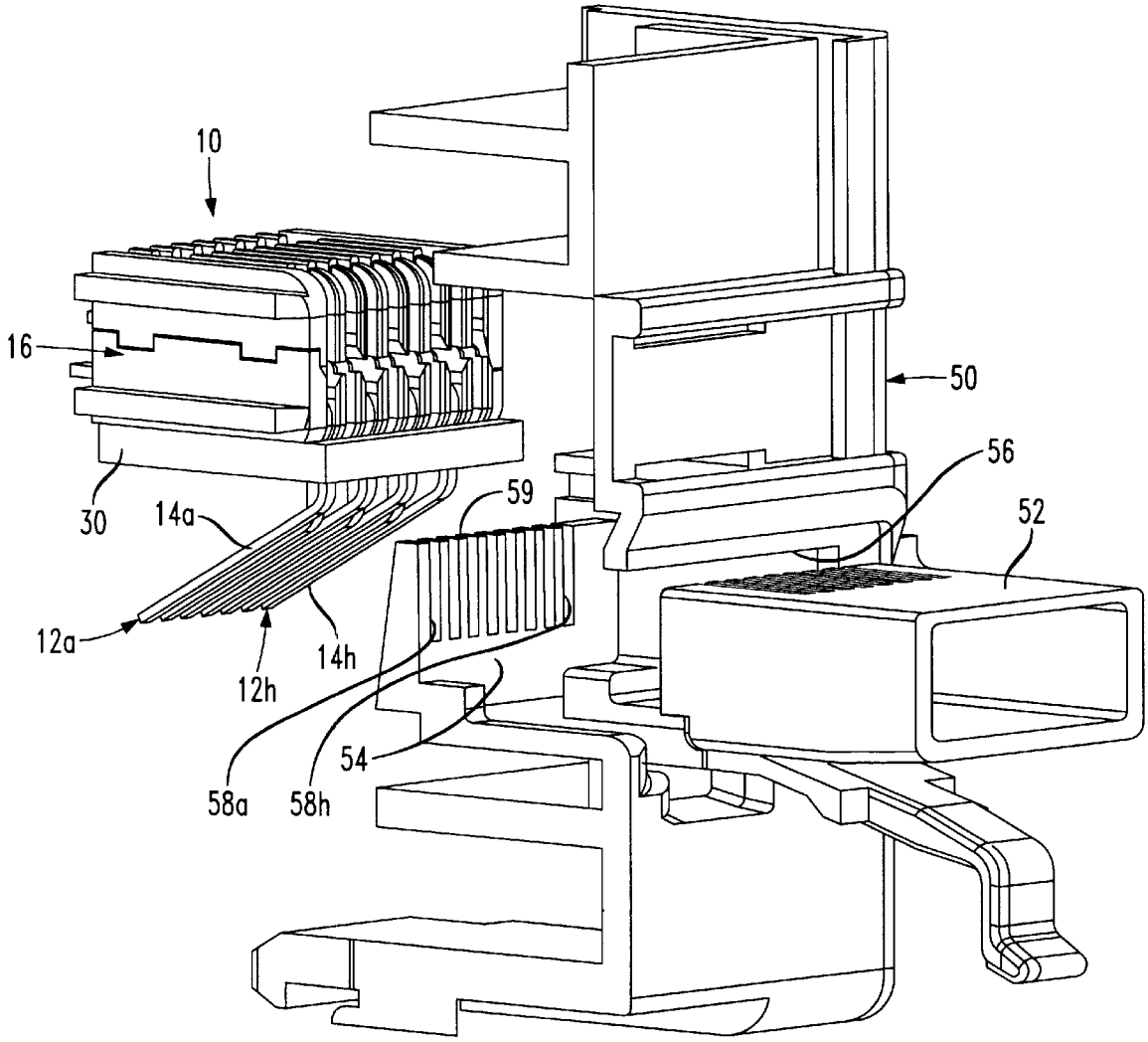
FIG. 3 is a perspective view of the communication connector assembly in FIG. 1 in position to be installed in a connector panel.
Figure 4:
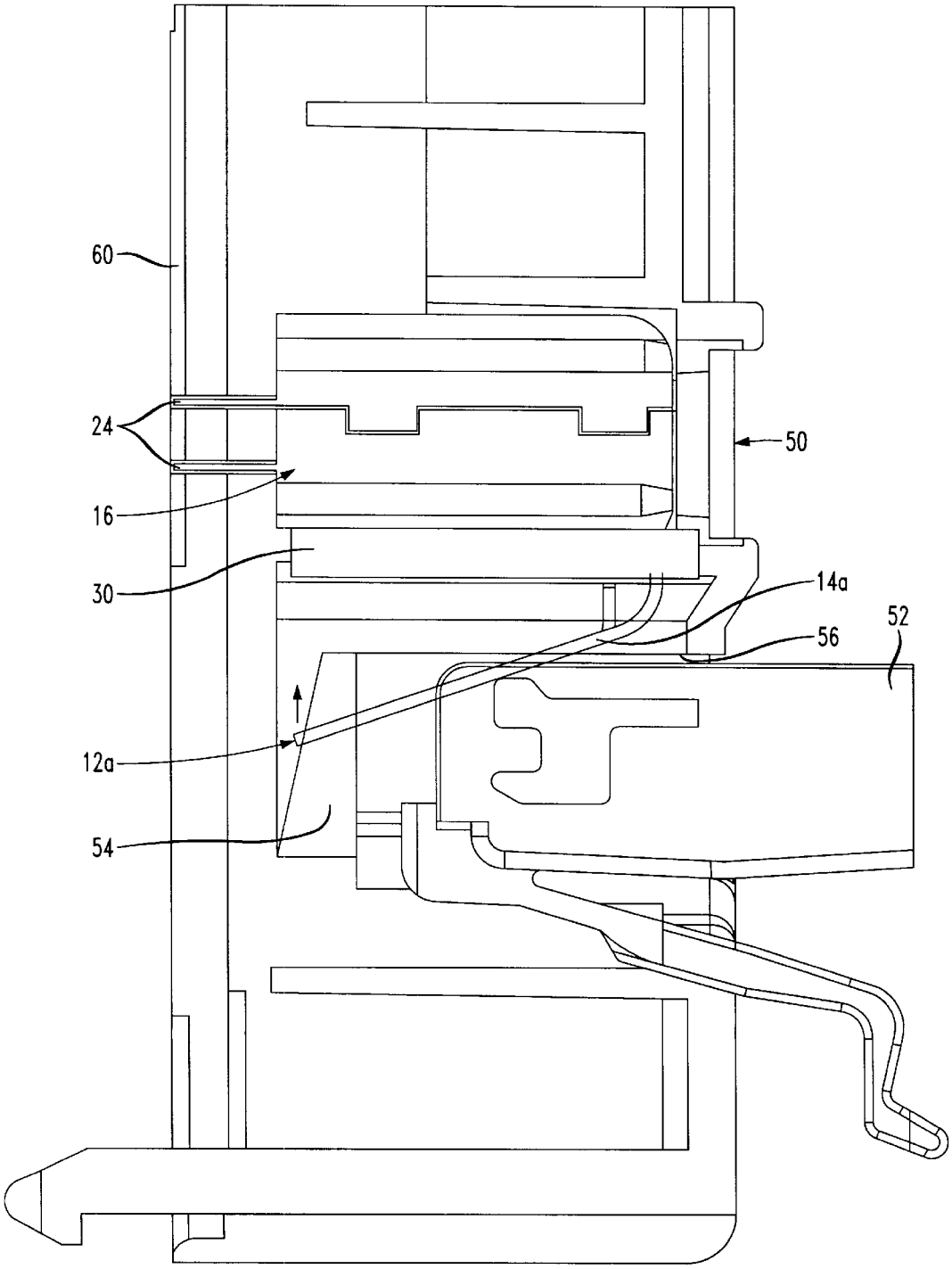
FIG. 4 is a side view showing the connector assembly installed in the panel in FIG. 3, and a mating connector in engagement with the connector assembly.

FIG. 3 is a perspective view of the communication connector assembly 10 in FIG. 1, in position to be installed in a connector panel 50. FIG. 4 is a side view of the connector assembly 10 in FIG. 1, installed in the panel 50 in FIG. 3 and showing a mating connector 52 electrically connected to the connector assembly 10 in the panel 50. The panel 50 can be one known as a "Patchmax" distribution module and may accommodate, for example, up to six communication connector assemblies 10 with little, if any, modification to existing panel modules. "Patchmax" is a registered trademark of Lucent Technologies Inc.

As shown in FIG. 3, the panel 50 has a back wall 54 supported vertically a certain distance behind a connector opening 56 cut in the panel. The wall 54 has, for example, eight parallel vertical slots 58*a*–58*h* opening along a top edge 59 of the wall 54. The first portions 14*a*–14*h* of the connector terminals are seated within corresponding ones of the slots 58*a*–58*h* when the terminal housing 16 is mounted on the panel 50 as in FIG. 4.

When the mating connector 52 is inserted in the connector opening 56 in the panel 50, terminals exposed on the connector 52 electrically contact corresponding first terminal portions 14*a*–14*h* of the connector assembly terminals 12*a*–12*h*. The first terminal portions are deflected upward and are each guided for vertical movement within the slots 58*a*–58*h* in the panel back wall 54. As seen in FIG. 4, the first terminal portions are urged upward in the direction of the circuit component 30 next to the terminal housing 16.

Cross talk produced when the connector 52 is mated to the connector assembly 10 and contacts the first terminal portions 14*a*–14*h*, is compensated by operation of the electrical circuit component 30. As seen in FIG. 4, the component 30 is located just above and extends parallel to exposed wire terminals of the mating connector 52. Also, only those parts of the parallel first terminal portions 14*a*–14*h* adjacent the circuit component 30 act to connect the terminals of the mating connector 52 electrically to the compensation component.

As shown in FIG. 4, an outside circuit board 60 is mounted at the rear of the connector panel 50 to receive the terminal posts 24, at the back of the connector terminal housing 16. The board 60 may also have printed wire traces, discrete elements or other devices which alone or in combination serve to compensate for or to reduce cross talk that is present on signal paths carried by the terminal posts 24.

Figure 5:
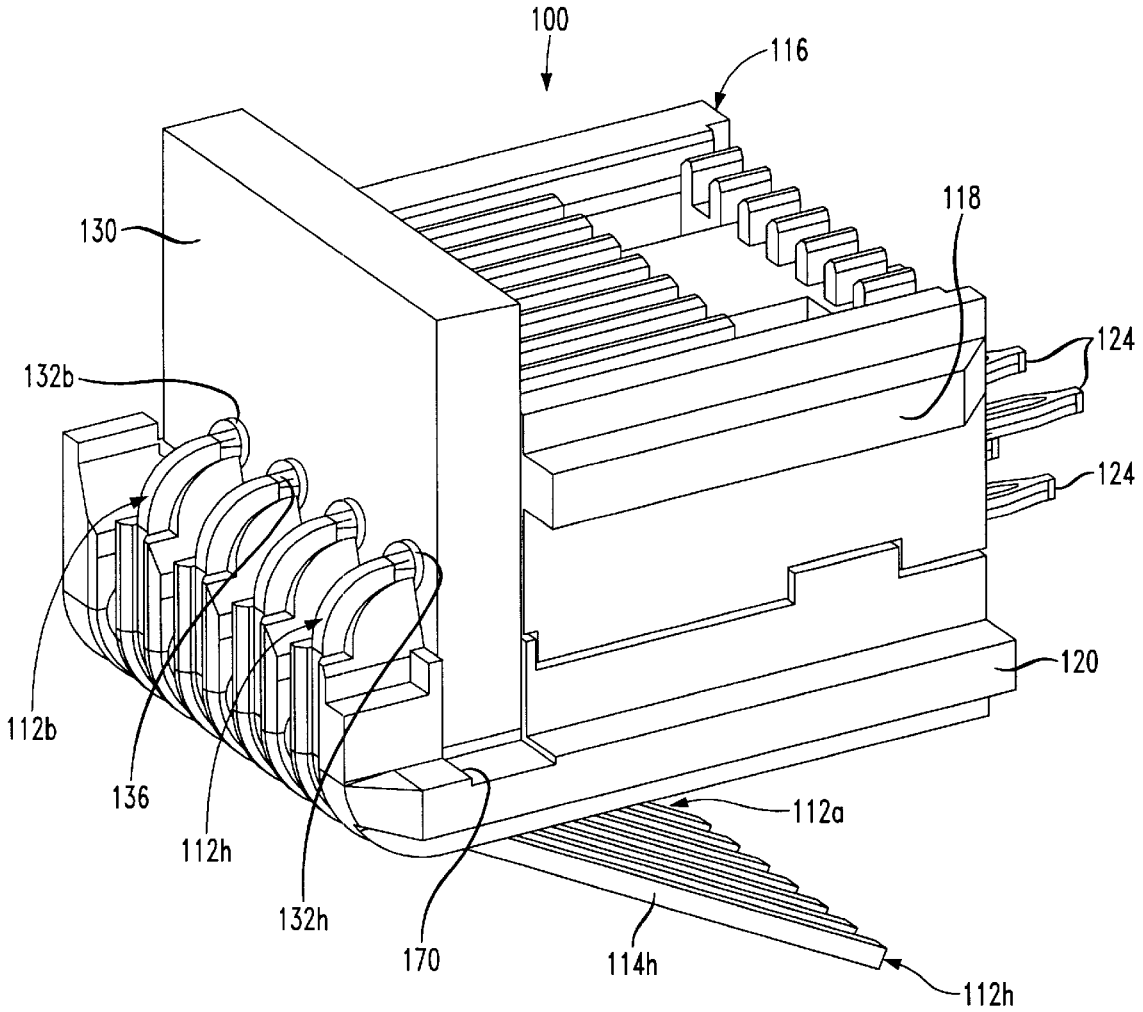
FIG. 5 is a perspective view of a second embodiment of a communication connector assembly.
Figure 6:
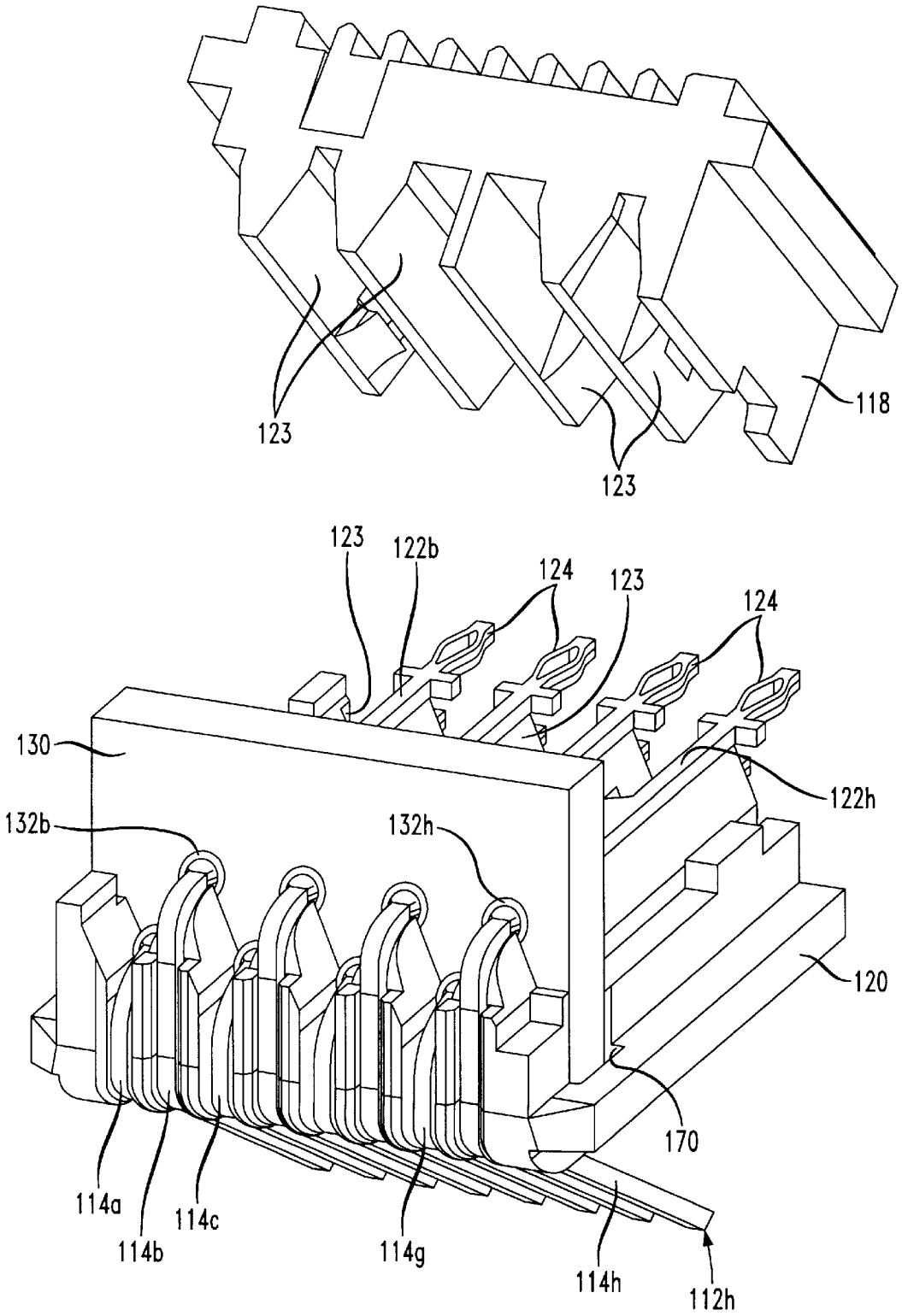
FIG. 6 is an exploded view of the connector assembly in FIG. 5.

FIGS. 5 and 6 are perspective views of a second embodiment of a communication connector assembly 100. Parts that are the same or similar to those of the connector assembly 10 in FIGS. 1–4, have the same reference numbers increased by 100.

In the arrangement of FIGS. 5 and 6, an electrical circuit component 130 is seated on a top surface of a housing bottom part 120 in an upstanding position, and contact portions 136 of connector assembly terminals 112*a*–112*h* are fitted in corresponding openings in component terminals 132*a*–132*h*. Second terminal portions 122*a*–122*h* of the assembly terminals are seated in corresponding guideways formed in a terminal housing 116. A side edge of the circuit component 130 is seated in a channel 170 formed transversely in the top surface of the housing bottom part 120. Like the connector assembly 10 of the first embodiment, the embodiment of FIGS. 5 and 6 provides efficient cross talk compensation, and has an exterior configuration that facilitates mounting on existing frames or panel modules.

In the above embodiments, the circuit component 30 (or 130) is directly mounted on and electrically connected to jack wire terminals of a modular communication jack, at portions of the terminals in proximity to their points of connection with a mating modular plug. For increased high-frequency performance, further stages of cross talk compensation can be provided on a main circuit board mounted at the rear of the connector assembly. If the circuit component 30 (or 130) is the only component provided to compensate for resultant cross talk, it should be constructed and arranged to produce cross talk of a substantially equal magnitude but of opposite phase to that induced by the combination of the mating plug connector 52 with the connector assembly 10 (or 100). If multiple stages of cross talk compensation are required, as may be needed for Category 6 performance levels, the circuit component 30 should have a compensation arrangement at least sufficient to compliment other stages of compensation that can be provided on the main circuit board (e.g., board 60) to which the connector assembly 10 is connected via terminal posts 24. The circuit component 30 together with the compensation stages on the circuit board 60 may then cooperate effectively to reduce undesired cross talk at higher performance levels.

Figure 7:
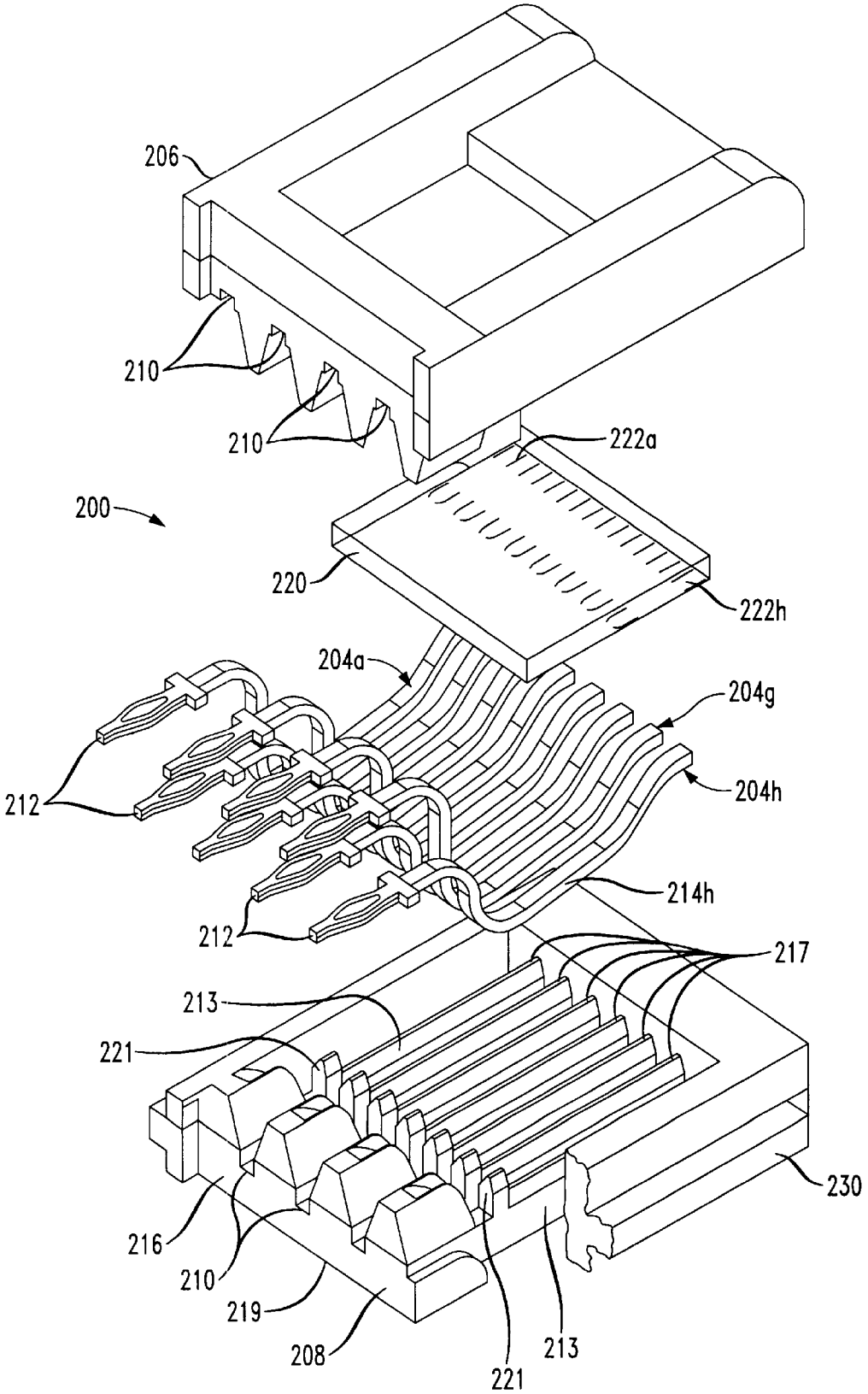
FIG. 7 is an exploded view of a third embodiment of a communication connector assembly.
Figure 8:
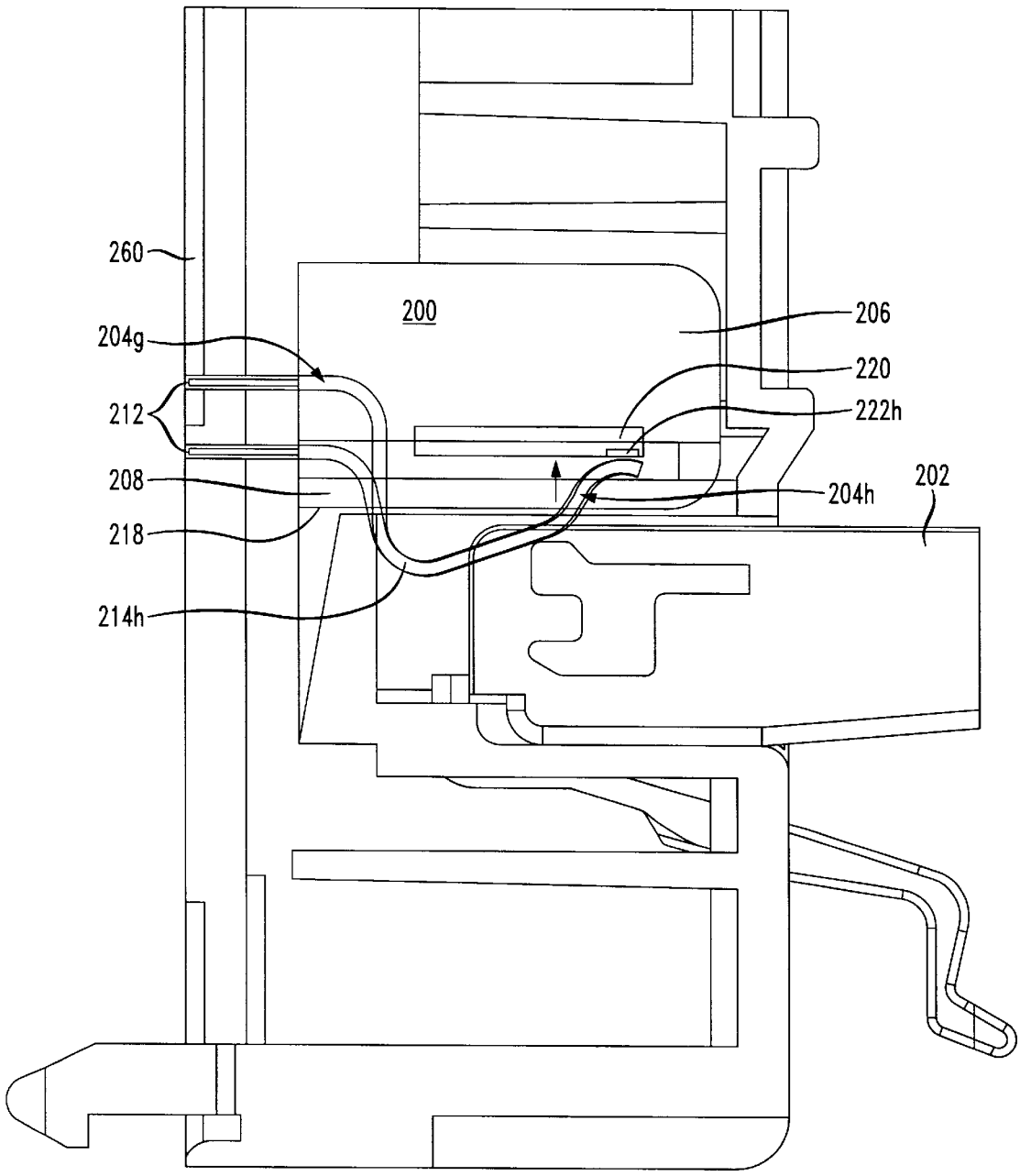
FIG. 8 is a side view showing the connector assembly in FIG. 7 in an assembled state, and a mating connector engaging the connector assembly.

FIG. 7 is an exploded view of a third embodiment of a communication connector assembly 200. FIG. 8 is a side view showing the connector assembly 200 in FIG. 7 in an assembled state, and a mating connector 202 in engagement with the connector assembly 200.

The assembly 200 includes a number, for example, eight electrically conductive connector assembly terminals 204*a* thru 204*h*. In the illustrated embodiment, the terminals are in the form of continuous, elongated jack wires which are supported by a terminal housing comprising a housing top part 206 and a housing bottom part 208. The terminals are seated at one end within corresponding parallel guideways 210 that are formed when the top part 206 and the bottom part 208 of the housing are snapped or otherwise joined together from the position in FIG. 7 to that shown in FIG. 8.

Outside connection ends of the connector assembly terminals have corresponding terminal posts 212 projecting from the rear of the terminal housing, i.e., toward the left side in FIG. 8. As in the first and the second embodiments, the posts 212 may have a known needle eye construction that allows them to be received firmly in through terminals on an outside circuit board. The posts 212 may take other known forms such as, for example, the earlier mentioned IDC terminals for connecting with outside wire leads.

As seen in FIGS. 7 and 8, the connector assembly terminals 204*a*–204*h* extend between the front and the back of the terminal housing interior between parallel ribs or partition walls 213. The tops of the partition walls may have side edges which are chamfered to facilitate positioning of the terminals between the walls from above. All of the partition wall tops collectively define a component rest surface 217.

The terminals 204*a*–204*h* have mid-sections 214*a*–214*h* that bow downward. The mid-sections pass through corresponding parallel slots 215*a*–215*h* that are cut in a lower wall 216 of the housing bottom part 208, between the partition walls 213. The slots 215*a*–215*h* extend only partially between the front and the back of the lower wall 216, and front and back end walls 218 of the slots have arcuate profiles to conform with bend radii of the connector assembly terminals at opposite ends of the terminals. The terminal mid-sections are thus firmly supported by the front and the back end walls 218 of the slots 215*a*–215*h*, and protrude a certain distance from a bottom surface 219 of the housing lower wall 216. The mid-sections 214*a*–214*h* are configured to become aligned with and to contact corresponding exposed wire terminals on the mating plug connector 202, as shown in FIG. 8.

The connector assembly terminals 204*a*–204*h* have free ends adjacent the mid-sections 214*a*–214*h* and opposite the outside connection ends of the terminals. The terminal free ends are preferably arranged so that in the absence of a component resting atop the partition walls 213, the free ends would rise beyond the rest surface 217 when the terminals 204*a*–204*h* are urged upward by the action of a mating connector.

Prior to joining the housing top and bottom parts 206, 208 to one another, the connector assembly terminals 204*a*–204*h* are nested between the partition walls 213 and the end walls 218 of the slots 215*a*–215*h*, in the bottom part 208. An electrical circuit component 220 is placed on the rest surface 217 formed by the partition walls. The component 220 is confined within a space formed between the housing top and bottom parts 206, 208 when the parts are joined. Also, the partition walls 213 may have posts 221 near back ends of the walls which posts 221 serve to limit movement of the component 220 toward the back of the terminal housing. Like the circuit component 30 or 130 in the first two embodiments, the component 220 may comprise a multilayer printed wire board that is configured to compensate for cross talk which develops when the plug connector 202 mates with the connector assembly 200 and contacts the terminal mid-sections 214*a*–214*h*.

Component 220 has a number of terminal contact pads 222*a*–222*h* aligned along a bottom forward edge of the component, as viewed in the drawing. The contact pads connect to compensating elements (not shown) such as, e.g., internal printed wire traces, and any other discrete elements of the component such as resistors, inductors, capacitors or active devices. The free ends of the connector assembly terminals 204*a*–204*h* are dimensioned and arranged to contact corresponding ones of the component contact pads 222*a*–222*h*. When the mating connector 202 engages the connector assembly 200, the free ends of the assembly terminals 204*a*–204*h* are urged against the contact pads to make reliable electrical connections with the circuit component 220.

In the embodiment of FIGS. 7 and 8, the circuit component 220 is mounted inside the terminal housing of the connector assembly 200, and becomes electrically connected to the assembly terminals 204*a*–204*h* at free ends of the terminals adjacent the terminal mid-sections 214*a*–214*h*, when the midsections are engaged by the mating connector 202. The mating connector thus becomes electrically connected to the circuit component 220 through paths between the mid-sections and the free ends of the assembly terminals, in proximity to the compensation component.

Further stages of cross talk compensation can be provided on a main circuit board 260 mounted at the rear of the of the connector assembly 200, for increased high-frequency performance. If the circuit component 220 is the only component provided to compensate for resultant cross talk, the component should be constructed and arranged to produce cross talk of a substantially equal magnitude but of opposite phase to that induced by the combination of the mating connector 202 with the connector assembly 200.

If multiple stages of cross talk compensation are needed for higher performance levels, the circuit component 220 should operate at least to compliment other stages of compensation that can be provided on the main circuit board 260 to which the connector assembly 200 is connected via terminal posts 212, and the circuit component 220 together with the compensation stages on the main circuit board may cooperate effectively to reduce undesired cross talk at higher performance levels. Also, the bottom part 208 of the terminal housing may have side flanges 230 and other outside mounting features to allow a number of like connector assemblies 200 to be mounted on existing distribution modules (e.g., the mentioned "Patchmax" modules) with little, if any, modifications.

Figure 9:
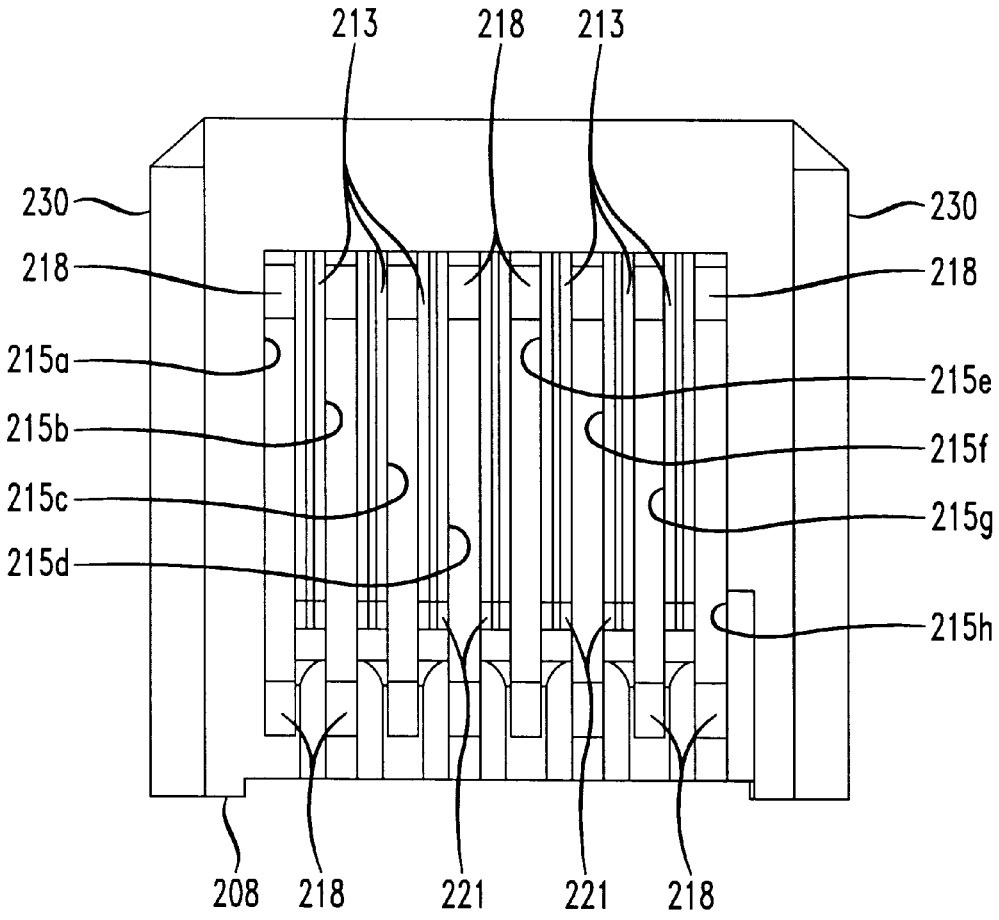
FIG. 9 is a perspective view looking down on an inside portion of a terminal housing in FIGS. 7 and 8.

The electrical circuit component 220 in the embodiment of FIGS. 7–9 may be omitted to provide a "lower performance" version of the connector assembly 200, at a lower manufacturing cost. If necessary, suitable means including, for example and without limitation, a bare dielectric board may be placed inside the terminal housing instead of the component 220 to constrain movement of the free ends of the connector assembly terminals 204*a*–204*h*, when the mating connector 202 engages the mid-sections 214*a*–214*h* of the terminals. Also, one or more of the partition walls 213 shown in the drawing may be omitted, provided a sufficient rest surface 217 remains on which to mount the component 220 or other part.

While the foregoing description represents preferred embodiments of the invention, it will be obvious to those skilled in the art that various changes and modifications may be made, without departing from the spirit and scope of the invention as pointed out by the following claims.

What is claimed is:

1. An electrical connector assembly, comprising:

a terminal housing;

a number of electrically conductive connector assembly terminals supported by said housing, wherein the assembly terminals have mid-sections that protrude from said housing for contacting corresponding terminals of a mating connector, and outside connection ends for making connections with outside circuits;

wherein free ends of the connector assembly terminals adjacent the mid-sections of the terminals and opposite the outside connection ends, are positioned inside the terminal housing; and an electrical circuit component mounted inside the terminal housing;

wherein the circuit component is connected electrically to the free ends of the connector assembly terminals so that the mating connector will be electrically connected to the circuit component through paths between the mid-sections and the free ends of the assembly terminals.

2. A connector assembly according to claim 1, wherein said connector assembly terminals are in the form of elongated, continuous jack wires.

3. A connector assembly according to claim 1, wherein the electrical circuit component has a number of terminal contact pads, and the free ends of the connector assembly terminals contact corresponding ones of the contact pads.

4. A connector assembly according to claim 1, wherein the outside connection ends of said assembly terminals comprise terminal posts projecting from the terminal housing for connection with said outside circuits.

5. A connector assembly according to claim 1, wherein said electrical circuit component is constructed and arranged to produce cross talk of substantially equal magnitude and opposite phase to cross talk produced when the mating connector contacts the mid-sections of the connector assembly terminals.

6. The connector assembly of claim 1, wherein the electrical circuit component is a first stage of a multi-stage cross talk compensation arrangement.

7. The connector assembly of claim 6, wherein said multi-stage compensation arrangement comprises an outside circuit board to which the outside connection ends of said connector assembly terminals are connected.

8. A connector assembly according to claim 1, wherein a bottom part of said terminal housing has a number of parallel slots, and the mid-sections of the connector assembly terminals pass through corresponding ones of said slots.

9. A connector assembly according to claim 8, wherein the bottom part of said terminal housing has a number of parallel partition walls, and said assembly terminals extend between said partition walls.

10. A connector assembly according to claim 9, wherein tops of said partition walls define a rest surface on which the electrical circuit component is disposed inside the terminal housing.

11. A connector assembly according to claim 1, including an outside printed wire board connected to the outside connection ends of said assembly terminals, wherein said outside printed wire board is configured to compensate for cross talk, in cooperation with the electrical circuit component.

12. A distribution module comprising:

a panel having a connector opening for receiving a mating connector; and an electrical connector assembly mounted to said panel for engaging said mating connector when the mating connector is inserted in the connector opening in the panel, said connector assembly comprising;

a terminal housing;

a number of electrically conductive connector assembly terminals supported by said housing, wherein the assembly terminals have mid-sections that protrude from said housing for contacting corresponding terminals of a mating connector, and outside connection ends for making connections with outside circuits;

wherein free ends of the connector assembly terminals adjacent the mid-sections of the terminals and opposite the outside connection ends, are positioned inside the terminal housing; and an electrical circuit component mounted inside the terminal housing;

wherein the circuit component is connected electrically to the free ends of the connector assembly terminals so that the mating connector will be electrically connected to the circuit component through paths between the mid-sections and the free ends of the assembly terminals.

13. The module of claim 12, wherein said connector assembly terminals are in the form of elongated, continuous jack wires.

14. The module of claim 12, wherein the electrical circuit component has a number of terminal contact pads, and the free ends of the connector assembly terminals contact corresponding ones of the contact pads.

15. The module of claim 12, wherein the outside connection ends of said assembly terminals comprise terminal posts projecting from the terminal housing for connection with said outside circuits.

16. The module of claim 12, wherein said electrical circuit component is constructed and arranged to produce cross talk of substantially equal magnitude and opposite phase to cross produced when the mating connector contacts the mid-sections of the connector assembly terminals.

17. The module of claim 12, wherein the electrical circuit component is a first stage of a multi-stage cross talk compensation arrangement.

18. The module of claim 17, wherein said multistage compensation arrangement comprises an outside circuit board to which the outside connection ends of said connector assembly terminals are connected.

19. The module of claim 12, wherein a bottom part of said terminal housing has a number of parallel slots, and the mid-sections of the connector assembly terminals pass through corresponding ones of said slots.

20. The module of claim 12, wherein the bottom part of said terminal housing has a number of parallel partition walls, and said assembly terminals extend between said partition walls.

21. The module of claim 20, wherein tops of said partition walls define a rest surface on which the electrical circuit component is disposed inside the terminal housing.

22. The module of claim 12, including an outside printed wire board connected to the outside connection ends of said assembly terminals, wherein said outside printed wire board is configured to compensate for cross talk in cooperation with the electrical circuit component.

* * * * *